US006516074B1

(12) United States Patent
Brimhall et al.

(10) Patent No.: US 6,516,074 B1
(45) Date of Patent: Feb. 4, 2003

(54) HEARING DEVICE WITH INTEGRATED BATTERY COMPARTMENT AND SWITCH

(75) Inventors: Owen D. Brimhall, South Jordan; Gregory N. Koskowich, Salt Lake City, both of UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

(21) Appl. No.: 09/692,263

(22) Filed: Oct. 19, 2000

(51) Int. Cl.[7] ..... H04R 25/00
(52) U.S. Cl. ..... 381/322; 381/323
(58) Field of Search ..... 381/323, 312, 381/328, 329, 322; 439/500, 504; 429/96, 97, 100, 123

(56) References Cited

U.S. PATENT DOCUMENTS

| | | | | |
|---|---|---|---|---|
| 4,634,815 A | * | 1/1987 | Marquis | |
| 4,739,512 A | * | 4/1988 | Hartl et al. | 381/312 |
| 4,880,076 A | | 11/1989 | Ahlberg et al. | 181/130 |
| 5,002,151 A | | 3/1991 | Oliveira et al. | 181/130 |
| 5,031,219 A | | 7/1991 | Ward et al. | 381/68.6 |
| 5,188,540 A | | 2/1993 | Aktiengesellschaft | |
| 5,201,007 A | | 4/1993 | Ward et al. | 381/68.6 |
| 5,675,657 A | * | 10/1997 | Giannetti | 381/312 |
| 5,920,636 A | | 7/1999 | Oliveira et al. | 381/328 |
| 5,995,636 A | * | 11/1999 | Topholm | 381/323 |
| 5,996,584 A | | 12/1999 | Oliveira et al. | 128/864 |
| 6,179,085 B1 | * | 1/2001 | Brimhall et al. | 181/135 |

FOREIGN PATENT DOCUMENTS

| | | |
|---|---|---|
| JP | 09215098 | 8/1997 |
| WO | WO 93/25053 | * 12/1993 |
| WO | WO 97/04619 | 2/1997 |

* cited by examiner

*Primary Examiner*—Sinh Tran
(74) *Attorney, Agent, or Firm*—Jones, Waldo, Holbrook & McDonough; Michael W. Starkweather; Brent T. Winder

(57) ABSTRACT

A hearing device comprises a housing having an outer wall and a compartment adapted to receive a battery. The battery forms a portion of the housing outer wall when engaged with the compartment. The hearing device compartment also includes an integrated switch comprising a contact adapted to engage the battery in response to a deformation of the hearing device, and a conformal tip adapted to engage with the housing such that the conformal tip surrounds the compartment and the engaged battery.

18 Claims, 3 Drawing Sheets

HEARING DEVICE WITH INTEGRATED BATTERY COMPARTMENT AND SWITCH

FIELD OF THE INVENTION

The present invention pertains to hearing devices. More particularly, the present invention pertains to a hearing aid battery compartment that includes an integrated switch.

BACKGROUND OF THE INVENTION

The modern trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices, which are cosmetically less visible, but more sophisticated, are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Audiologists and physicians routinely offer three main types of In-The-Canal hearing devices. In-The-Ear (ITE) devices rest primarily in the concha of the ear and have the disadvantages of being fairly conspicuous to a bystander and relatively bulky and uncomfortable to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages that these types of in-the-canal devices provide, they also have several performance advantages that larger, externally mounted devices do not offer. Placing the hearing device deep within the ear canal and close to the tympanic membrane (ear drum) improves the frequency response of the device, reduces distortion due to jaw extrusion, reduces the occurrence of occlusion effects and improves overall sound fidelity. Earlier generation hearing devices function primarily by sound amplification and are typically not altered to a user's particular hearing impairment. Modern electronics allow specific sound processing schemes to be incorporated into the hearing device. Similarly, custom programming can be incorporated into the hearing device circuitry allowing a truly custom device for any particular user.

The shape and structure (morphology) of the ear canal varies from person to person. However, certain characteristics are common to all individuals. When viewed in the transverse plane, the path of the ear canal is extremely irregular, having several sharp bends and curves. The overall cross section of the ear canal generally constricts as you move deeper into the ear canal. It is these inherent structural characteristics that create problems for the acoustic scientist and the hearing device designer.

For general discussion purposes, the ear canal can be broken into three main segments. The external and medial segments are both surrounded by a relatively soft cartilaginous tissue. The external segment is largely visible from the outside and represents the largest cavity of the ear canal. The innermost segment of the ear canal, closest to the tympanic membrane, is surrounded by a denser bony material and is covered with only a thin layer of soft tissue. The presence of this bony material allows for little expansion to occur in this region compared with the cartilaginous regions of the ear canal. In addition to being surrounded by cartilage rather than bone, these areas are covered with a substantially thicker tissue layer. Since there is less cushion, pressure exerted by a hearing device on the inner bony region of the canal can lead to discomfort and/or pain, especially when a deep insertion technique is used.

Since the morphology of the ear canal varies so greatly from person to person, hearing aid manufacturers and audiologists use custom manufactured devices in order to precisely fit the dimensions of a user's ear canal. This technique frequently requires impressions of the user's ear canal to be taken. The resulting mold is then used to fabricate a rigid hearing device shell. This process is both expensive and time consuming and the resulting rigid device shell does not perform well during the deformations of the ear canal that occur during normal jaw movement. In order to receive a properly fit hearing device, the user typically has to make several trips to the audiologist for reshaping and resizing. Even after the best possible fit is obtained, the rigid shell rarely provides comfortable hearing enhancement at all times.

Because the resulting hearing aid device shell is typically formed from a hard acrylic material, discomfort to the user is increased when worn for extended periods of time. The inability of the hard shell to conform to normal ear canal deformations can cause it to become easily dislodged from its proper position. Consequently, the quality of the hearing enhancement suffers. Furthermore, due to the added manufacturing costs, it is desirable to utilize a hearing device that is at least partially formed from an off-the-shelf or preformed component readily available to the audiologist or physician.

While the performance of CIC hearing devices are generally superior to other larger and less sophisticated devices, several problems remain. Complications typically arise due to the small size of CIC hearing devices and the depth that they are inserted into a user's ear canal.

Because a CIC hearing device forms an essentially airtight seal between the tip of the hearing device and the wall of the ear canal, discomfort to a user is common. This acoustic seal prevents the equalization of pressure between the internal chamber formed between the tympanic membrane and the hearing device, and the outside environment. Due to the sensitivity of the tympanic membrane, even small pressure differentials can cause severe discomfort. Additionally, since the acoustic seal is formed by pressure exerted by the hearing device, this can also lead to discomfort.

Due to their small size and positioning within the ear canal, CIC hearing devices can cause handling problems, making insertion and removal by a user difficult and cumbersome, and can often lead to damage to the hearing device. In the larger, BTE, or ITC hearing devices, the size of the device usually makes it unnecessary to incorporate a retrieval mechanism into its structure, i.e., the wearer normally will not have any difficulty grasping the device in order to remove it. But in smaller hearing devices, such as a CIC device, retrieval cords and other extraction tools become a necessary addition in order to allow for easy and safe removal by the user.

Additional problems arise with hearing devices, especially CIC devices, from the use of relatively small batteries as a power source. Due to their small size and frequent use, hearing aid batteries must be replaced frequently. Known hearing devices use a hinged battery door positioned on the faceplate of the hearing device that is particularly conspicuous. Furthermore, a finger tab, used to open and close the hinged battery door, and a door snap are also included in the structure of the battery door. Given the small size of the CIC devices and the complexity of the battery compartment, it is often difficult to replace the battery. Manual activation switches (i.e., on/off switches) also pose problems with known hearing devices. Given the reduced size of CIC devices, these switches are typically small and difficult to manipulate.

In addition to the handling problems, the multiple components used in hinged battery doors and manual switches add excess material and bulk to the hearing device. This increases the size of the hearing device, the cost of fabrication, and adds to the difficulty of mass production. It is therefore desirable to have a hearing device that does not require a hinged battery door or a manual activation switch.

SUMMARY OF THE INVENTION

A hearing device constructed in accordance with the present invention comprises a housing having an outer wall and a compartment adapted to receive a battery. The battery forms a portion of the housing outer wall when engaged with the compartment. Preferably, the hearing device comprises a conformal tip adapted to engage with the housing such that the conformal tip surrounds the battery compartment and the battery.

In a further embodiment of a hearing device constructed in accordance with the present invention, the hearing device comprises a housing, the housing having an outer wall and a battery compartment, the battery compartment comprising an integrated switch. The integrated switch comprises a contact adapted to engage a battery in response to a deformation of the hearing device. The integrated switch preferably interfaces with a digital circuit providing access to various programs and devices within the hearing device.

Further aspects of a hearing device constructed in accordance with the present invention will become apparent hereinafter.

BRIEF DESCRIPTION OF THE DRAWINGS

The drawings illustrate both the design and utility of the preferred embodiments of the present invention, in which similar elements in different embodiments are referred to by the same reference numbers for purposes of ease in illustration, wherein.

DETAILED DESCRIPTION OF THE PREFERRED EMBODIMENTS

Figure 1:
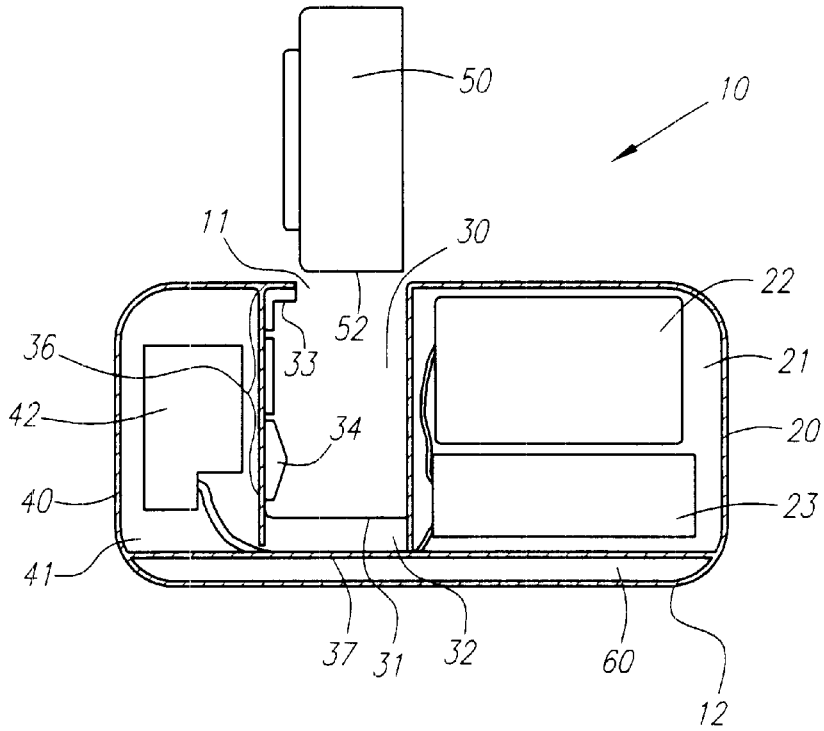
FIG. 1 is a cross-sectional view of a receiver module of a hearing device constructed in accordance with the present invention.

FIG. 1 shows a cross-sectional view of a receiver module 10 that is used in conjunction with a completely in-the-canal hearing device. The receiver module 10 is a housing that contains a variety of hearing device electronics and other operative components, e.g., a hearing device receiver (amplification and speaker system), sound processing circuitry, a microphone, and a power source. Among other features of the receiver module 10, which will be described in more detail below, it protects the sensitive hearing device components from damage due to moisture, dirt, cerumen (ear wax), and user interference. Additionally, the receiver module 10 preferably prevents electromagnetic energy from interfering with the hearing device electronics.

Figure 2:
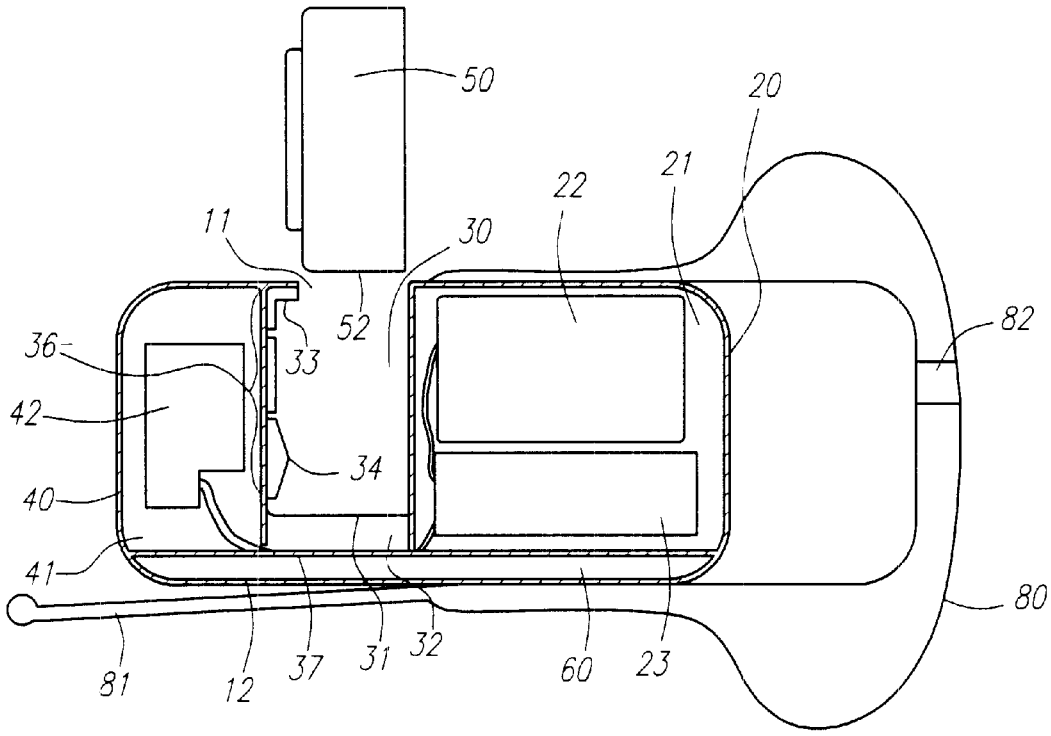
FIG. 2 is a cross-sectional view of the receiver module partially engaged with a conformal tip.
Figure 3:
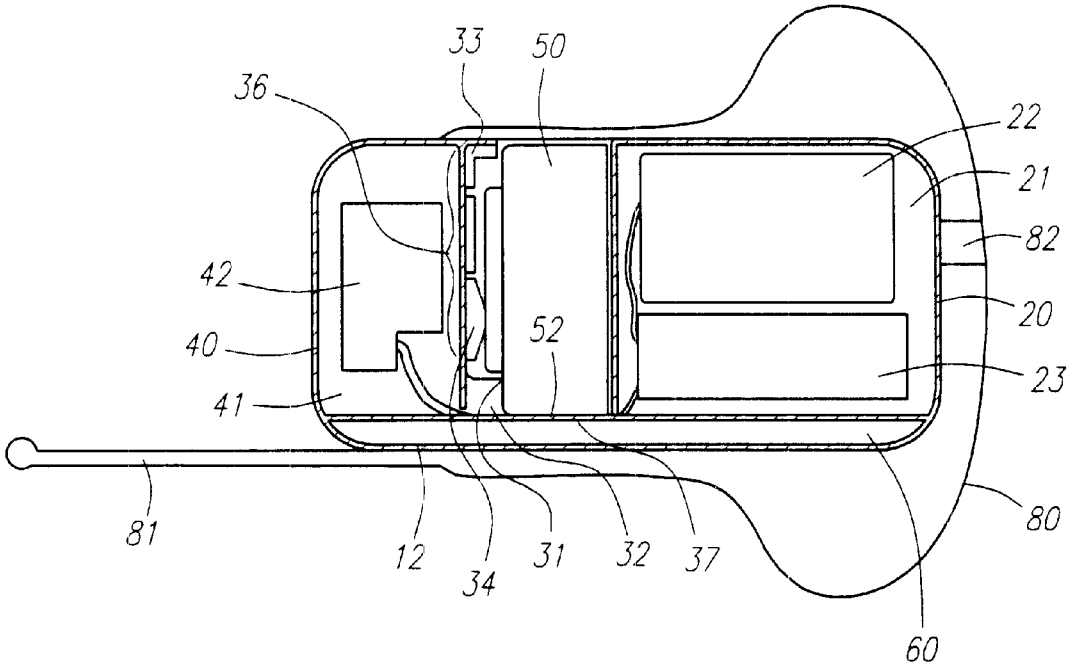
FIG. 3 is a cross-sectional view of the receiver module fully engaged with the conformal tip, with a battery inserted into a battery compartment.
Figure 4:
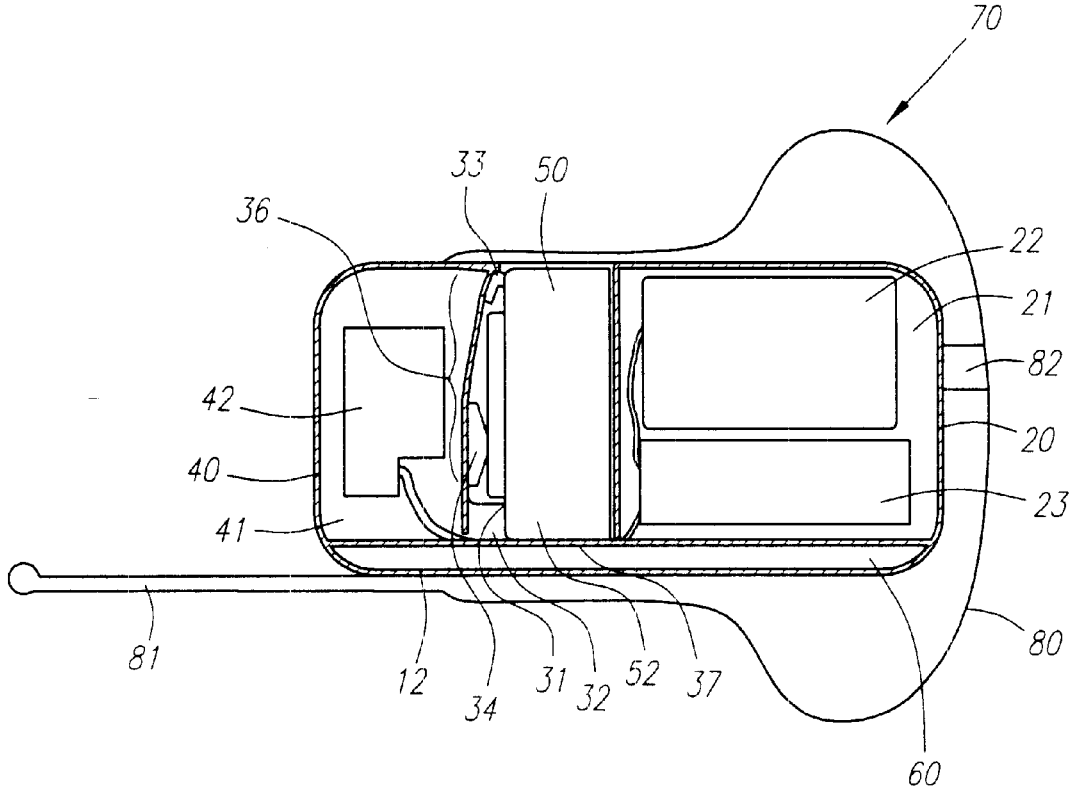
FIG. 4 is a cross-sectional view of the receiver module fully engaged with the conformal tip, and where an integrated switch is fully engaged with the battery in response to a force.

Preferably, as seen in FIGS. 2–4, the receiver module 10 is used in combination with a conformal tip 80. U.S. patent application Ser. No. 09/467,092, filed on Dec. 10, 1999, Ser. No. 09/231,282, filed on Jan. 15, 1999, and Ser. No. 09/231,266, filed on Jan. 15, 1999, each disclose and describe several examples of preferred conformal hearing aid tips, the details of which are hereby fully incorporated by reference into the present application. Preferably, the conformal tip 80 includes a retrieval cord 81.

The conformal tip 80 is preferably used in combination with a hearing aid retention and extraction device. U.S. patent application Ser. No. 09/409,793, filed Sep. 30, 1999 discloses and describes an example of a hearing aid retention and extraction device, the details of which are hereby fully incorporated by reference into the present application.

Referring again to FIG. 1, the receiver module 10 has a distal shell 20 and a proximal faceplate 40. As used herein, the term proximal refers to the portions of a hearing device and its components that are located closer to the exterior, or concha, of an ear canal when the hearing device is inserted into an ear canal, and the term distal refers to the portions of a hearing device and its components that are located at a deeper point within the ear canal. The shell 20 defines an internal chamber 21 and the faceplate 40 defines an internal chamber 41. A receiver 22 and a flexible circuit board assembly 23 are located within the internal chamber 21. Further, a microphone 42 is situated within the internal chamber 41.

A bottom portion 12 of the receiver module 10 has a pathway 60 that provides a vent between the proximal and distal ends of the receiver module 10. The pathway 60 also provides a duct for electrical connections. The pathway 60 allows pressure equalization between the inner regions of the ear canal, best seen in FIGS. 3 and 4, through an aperture 82 of the conformal tip 80, and the ambient environment. Alternately, the retrieval cord 81 may include its own a vent tube that provides the necessary pressure equalization.

A battery compartment 30 is situated between the shell 20 and the faceplate 40. The battery compartment 30 preferably comprises a structural member 31, located on a bottom portion 37 of the battery compartment 30, that connects the shell 20 and the faceplate 40. In this configuration, the battery compartment 30 is adapted to orient a battery 50 received through a top portion 11 of the receiver module 10.

Referring to FIGS. 3 and 4, the structural member 31 includes an extension 32 that acts as a seat for an engaged battery 50. When the battery 50 is engaged within the battery compartment 30, a bottom portion 52 of the battery 50 rests on the extension 32 preventing the battery 50 from sliding through the bottom portion 37 of the battery compartment 30. In this configuration, the battery 50, when inserted into the compartment 30, forms the peripheral walls of the battery compartment 30. This is illustrated by comparing FIGS. 1 and 2, where the battery compartment 30 is open and FIGS. 3 and 4, where the battery compartment 30 is filled by the battery 50.

In alternative embodiments, the battery compartment 30 can be placed in any advantageous orientation depending on the size of the hearing device and the orientation of internal components such as the microphone 42, the receiver 22, and the circuit board 23.

Figure 5:
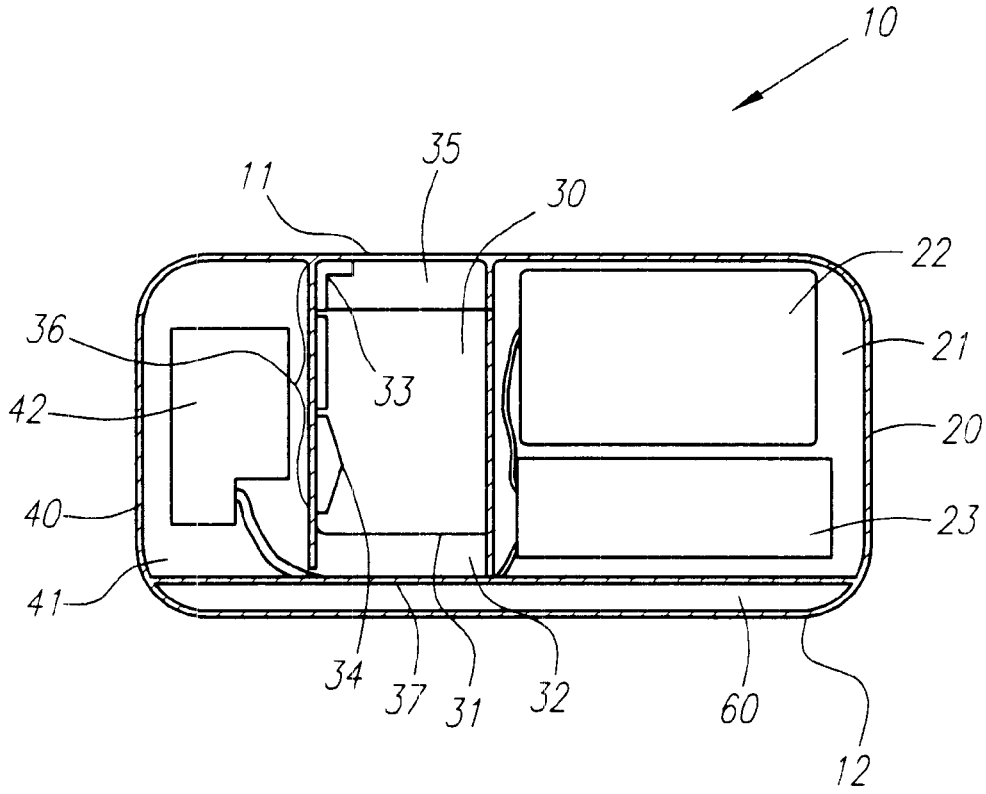
FIG. 5 is a cross-sectional view of a receiver module comprising an additional structural member.

In another embodiment, as seen in FIG. 5, an additional structural member 35 is placed on the top portion 11 of the receiver module 10. This configuration would allow the battery 50 to be inserted from either the top or the bottom of the receiver module 10. Furthermore, the additional structural member 35 provides added stiffness to the assembly of the receiver module 10.

The battery compartment 30 also includes an integrated switch 36 that provides a circuit connection between the battery 50 and the internal components of the hearing device, such as the microphone 42, the receiver 22, and the circuit board 23. As seen in FIGS. 1-4, the integrated switch 36 comprises a positive contact 33 and a negative contact 34.

Referring to FIGS. 3 and 4, the negative contact 34 is positioned near the center of the battery compartment 30, so that it continuously engages the battery 50. Furthermore, the positive contact 33 is positioned near the top of the battery compartment 30, so that it engages the battery 50 only in response to a force 70. Preferably, the force 70 is applied to the receiver module 10 by the pressure resulting from placing the hearing device into an ear canal.

The unbiased shape of the receiver module 10 causes the integrated switch 36 to have an open circuit, as shown in FIG. 3. However, as shown in FIG. 4, when the force 70 is applied to the receiver module 10, the slight deformation of receiver module 10 causes the positive contact 33 to engage the battery 50. In FIG. 4, the circuit is therefore closed.

When the force 70 is released, the receiver module 10 returns to its unbiased shape, with the positive contact 33 no longer engaged with the battery 50, once again opening the circuit that includes the integrated switch 36. When the circuit is closed, the internal circuitry, such as the microphone 42, the receiver 22, and the circuit board 23, receive power from the battery 50 and the hearing device is "on."

In an alternative embodiment, the positive contact 33 continuously engages the battery 50 and the negative contact 34 only engages the battery 50 in response to a deformation of the receiver module 10. In a further alternative embodiment, the negative contact 34 and the positive contact 33 both continuously engage the battery 50, and a deformation of the receiver module 10 opens the circuit causing at least one of the battery contacts to disengage with the battery 50.

As seen in FIGS. 3 and 4, the conformal tip 80 is adapted to engage with the receiver module 10 such that the conformal tip 80 surrounds the battery compartment 30 and the battery 50.

The receiver module 10 is configured to provide a stock configuration with respect to the internal circuitry, mechanical components, and electrical core components, that does not need to be modified for a particular individual's ear canal size. By making the construction of the receiver module universal, the receiver module can be easily used in either a right or left ear canal rather than being restricted to a particular ear. With the use of a soft conformal tip, the receiver module can be used in a variety of differently sized ear canals as well, truly making a receiver module constructed in accordance with the present invention universal and in conjunction with a conformal tip, a "one-size-fits-all" hearing device.

Although the invention has been described and illustrated in the above description and drawings, it is understood that this description is by example only and that numerous changes and modifications can be made by those skilled in the art without departing from the true spirit and scope of the invention. The invention, therefore, is not to be restricted, except by the following claims and their equivalents.

What is claimed is:

1. A hearing device comprising:

a housing, the housing having an outer wall and a compartment adapted to receive a battery, wherein the battery forms a portion of the housing outer wall when engaged with the compartment; and a substantially compliant conformal tip adapted to engage the housing such that the conformal tip surrounds the compartment and the engaged battery.

2. The hearing device of claim 1, wherein the conformal tip includes a retrieval cord.

3. The hearing device of claim 1, wherein the compartment includes an integrated switch adapted to respond to a deformation of the hearing device.

4. The hearing device of claim 3, wherein the deformation is in response to a force applied to the hearing device by an ear canal.

5. The hearing device of claim 3, wherein the integrated switch includes a battery contact, and wherein the deformation causes the battery contact to engage the battery.

6. The hearing device of claim 3, wherein the integrated switch includes a battery contact, and wherein the deformation causes the battery contact to disengage the battery.

7. A hearing device, comprising:

a housing, the housing having an outer wall and a battery compartment, the battery compartment including an electrical contact; and means for engaging a battery with the electrical contact in response to a deformation of the housing;

wherein the battery forms a portion of the housing outer wall when engaged with the battery compartment.

8. A hearing device comprising:

a housing, the housing having an outer wall and a battery compartment, wherein the battery compartment includes a contact adapted to engage a battery in response to a deformation of the hearing device; and a substantially compliant conformal tip adapted to engage the housing such that the conformal tip surrounds the battery compartment and the engaged battery.

9. The hearing device of claim 8, wherein the battery compartment is further adapted to orient the battery.

10. The hearing device of claim 8, wherein the conformal tip includes a retrieval cord.

11. A method for using a hearing device, said method comprising the steps of:

providing a hearing device, said hearing device comprising a housing having a battery compartment, wherein the battery compartment includes a contact adapted to contact a battery in response to a deformation of the hearing device; and inserting said hearing device into an ear canal thereby deforming the hearing device and causing the contact to engage the battery in response to the deformation.

12. The method of claim 11, wherein the hearing device further comprises a conformal tip adapted to engage the housing such that the conformal tip surrounds the battery compartment and the battery.

13. The method of claim 11, further comprising the step of removing the hearing device from the ear canal, wherein the hearing device returns to an unbiased shape, thereby disengaging the contact from the battery.

14. A hearing device, comprising:

a housing, the housing having an outer wall and a compartment adapted to receive a battery, wherein the battery forms a portion of the housing outer wall when engaged with the compartment, wherein the compartment includes an integrated switch adapted to respond to a deformation of the hearing device in response to a force applied to the hearing device by an ear canal.

15. The hearing device of claim 14, further comprising a conformal tip adapted to engage the housing such that the conformal tip surrounds the compartment and the engaged battery.

16. The hearing device of claim 15, wherein the conformal tip includes a retrieval cord.

17. The hearing device of claim 14, wherein the integrated switch includes a battery contact, and wherein the deformation causes the battery contact to engage the battery.

18. The hearing device of claim 14, wherein the integrated switch includes a battery contact, and wherein the deformation causes the battery contact to disengage the battery.

* * * * *